United States Patent [19]

Nakamura

[11] Patent Number: 4,667,569

[45] Date of Patent: May 26, 1987

[54] FLUID-PRESSURE DRIVING DEVICE

[75] Inventor: Ichiro Nakamura, Katsuta, Japan

[73] Assignee: Hitachi, Ltd., Tokyo, Japan

[21] Appl. No.: 758,034

[22] Filed: Jul. 23, 1985

[30] Foreign Application Priority Data

Jul. 25, 1984 [JP] Japan ..... 59-152810

[51] Int. Cl.[4] ..... F15B 15/17

[52] U.S. Cl. ..... 91/417 R; 91/461

[58] Field of Search ..... 60/413; 91/459, 461, 91/417 R; 137/625.64, 625.65, 625.6

[56] References Cited

U.S. PATENT DOCUMENTS

| | | | |
|---|---|---|---|
| 3,521,535 | 7/1970 | Oelrich | 91/417 R |
| 3,954,249 | 5/1976 | Gratzmuller | 91/461 X |
| 3,969,985 | 7/1976 | Greiger et al. | 91/459 X |
| 3,999,464 | 12/1976 | Greiger et al. | 91/417 R |
| 4,096,784 | 6/1978 | Ongaro | 91/461 X |
| 4,175,589 | 11/1979 | Nakamura et al. | 91/459 X |
| 4,204,461 | 5/1980 | Gratzmuller | 60/413 X |
| 4,276,809 | 7/1981 | Kast | 91/417 R |
| 4,289,063 | 9/1981 | Nakamura | 91/306 |

*Primary Examiner*—Edward K. Look

*Attorney, Agent, or Firm*—Antonelli, Terry & Wands

[57] ABSTRACT

A fluid-pressure driving device including a driving cylinder for producing a driving force, a main control valve for controlling the direction of movement of the driving cylinder and a fluid under pressure, and a pilot valve for controllng the main control valve. The main control valve includes a valve member in the form of a hollow cylinder, and a valve body constituting a part of a cylinder body of the driving cylinder. The valve member of the hollow cylindrical configuration is slidably interposed between the valve body and a sleeve of the pilot valve.

5 Claims, 3 Drawing Figures

FLUID-PRESSURE DRIVING DEVICE

BACKGROUND OF THE INVENTION

This invention relates to a fluid-pressure driving device suitable for use with equipment which requires a high-speed operation and a high degree of responsiveness, such as a circuit breaker.

Generally, a circuit breaker requires a high-speed operation. Ever-increasing demand for a supply of electricity and a resultant increase in transmission capacity have made it necessary in recent years for circuit breakers to have an increased capacity to handle a higher voltage. At the same time, they are required to effect breaking at high speed or to reduce the length of time required for effecting breaking, in order to ensure transient stability of the system. To achieve a reduction in the length of time required for effecting breaking makes it essential to shorten the length of time in which an arc is struck in the breaking section and to increase the speed at which the fluid-pressure driving device operates to bring contacts into and out of engagement with each other in the breaking section.

One type of fluid-pressure driving device known in the art used with a circuit breaker comprises, as disclosed in U.S. Pat. No. 4,289,063; for example, an operating cylinder for producing a driving force, a main control valve for controlling the direction of movement of the cylinder and a pilot valve for controlling the main control valve. It has hitherto been customary to fabricate the operating cylinder, main control valve and pilot valve as separate entities and assemble them together by connecting them through pipes or by bolts.

In this type of fluid-pressure driving device, the operating cylinder and main control valve would become larger in size when it is required to develop a high driving force. When it becomes necessary for the fluid-pressure driving device to operate at high speed, the main control valve would become still larger in size and the movable parts would have enhanced inertia, resulting in a slower speed of operation. Besides, it would become necessary to increase the size of the pilot valve, too. Thus, if the operating cylinder, main control valve and pilot valve were fabricated as separate entities and assembled together as has hitherto been the case, the channels connecting them together would become great in length and the transmission of pressure would be delayed or the resistance offered by the channels to the flow of the fluid would increase, making it impossible for the circuit breakers to operate at high speed with a high degree of responsiveness.

SUMMARY OF THE INVENTION

This invention has as its object the provision of a fluid-pressure driving device capable of operating equipment at high speed with a high degree of responsiveness.

To accomplish the aforesaid object, the invention provides improvements in or relating to a fluid-pressure driving device comprising a driving cylinder including a differential piston and a cylinder body for producing a driving force, a main control valve including a valve member and a valve body for controlling the direction of movement of the driving cylinder and a fluid under pressure, and a pilot valve including a pilot valve spool and a pilot valve sleeve for controlling the main control valve. The improvements include forming the valve member of the main control valve in the shape of a hollow cylinder, constructing the valve body of the main control valve in such a manner that it constitutes a part of the cylinder body and arranging the valve member in the form of a hollow cylinder between the valve body and the pilot valve sleeve for sliding movement.

DESCRIPTION OF A PRESENTLY PREFERRED EMBODIMENT

A preferred embodiment of the fluid-pressure driving device in conformity with the invention will now be described by referring to the accomapnying drawings.

Figure 1:
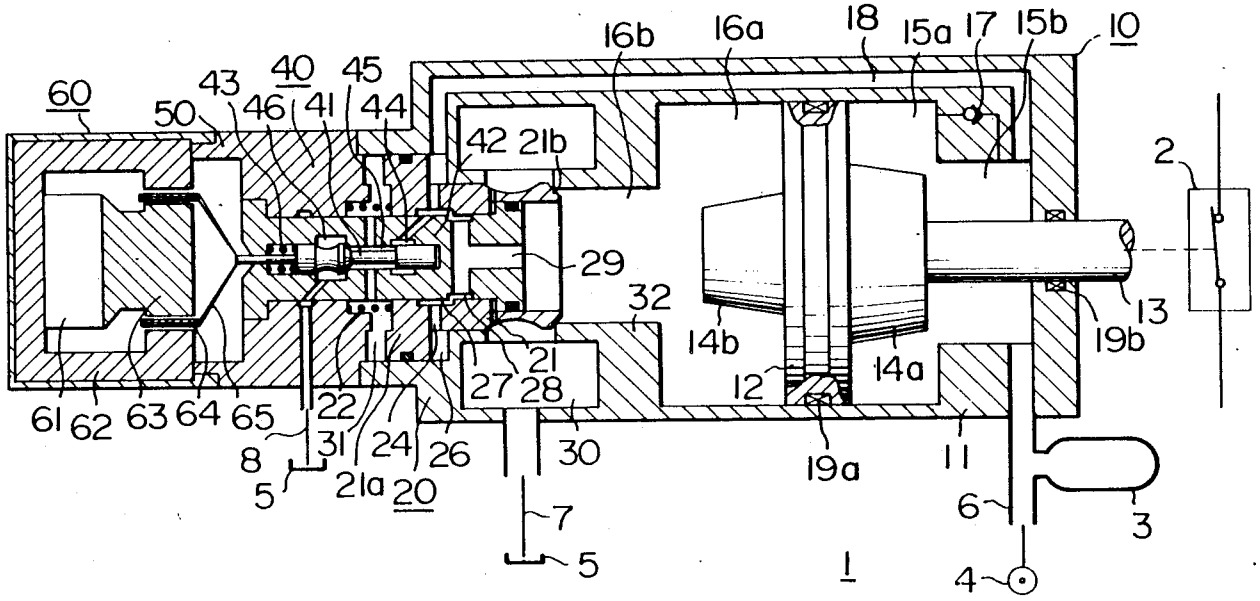
FIG. 1 is a sectional view of the fluid-pressure driving device comprising one embodiment of the invention.

FIG. 1 shows the fluid-pressure driving device according to the invention as incorporated in an operating apparatus for a circuit breaker for interrupting the flow of an electric current. Such operating apparatus comprises a fluid-pressure source 4, an auxiliary fluid-pressure source 3, a tank 5 and a fluid-pressure driving device 1 which drives a contact of a breaking section 2 for forming and breaking a circuit for an electric power system.

The hydraulic-pressure driving device 1 comprises a driving cylinder 10, a main control valve 20, a pilot valve 40 and a force motor 60. The driving cylinder 10 is composed of a cylinder body 11, a differential piston 12 located in the cylinder body for sliding movement, a check valve 17 and packings 19*a* and 19*b*. The piston 12 is formed at opposite sides with cushion protrusions 14*a* and 14*b*, and a piston rod 13 connected to the breaking section 2 extends through the cylinder body 11 to the outside. The cylinder body 11 and piston 12 define fluid chambers 15 and 16, the fluid chamber 15 being split into fluid chambers 15*a* and 15*b* by the cushion protrusion 14*a* of the piston 12 while leaving a narrow gap there-between when the piston 12 moves to a rightward position in FIG. 1 and the fluid chamber 16 being split into fluid chambers 16*a* and 16*b* by the cushion protrusion 16*b* of the piston 12 when the latter moves to a leftward position in FIG. 1. The packing 19*a* provides a seal between the fluid chambers 15 and 16 and the packing 19*b* between the fluid chamber 15 and outside the cylinder 10. The check valve 17 of the driving cylinder 10 allows a fluid to flow freely from the fluid chamber 15*b* to the fluid chamber 15*a* but prevents its flow from the fluid chamber 15*a* to the fluid chamber 15*b*. The fluid chamber 15*b* is maintained, through a channel 6, in communication with the auxiliary fluid-pressure source 3 and fluid-pressure source 4 which are an accumulator and a pump, respectively, in this embodiment. The contact of the breaking section 2 is connected, through the piston rod 13, to the piston 12 to act as a unit. Thus, when the piston 12 moves rightwardly in FIG. 1, a circuit is formed for the electric power system; when it moves leftwardly, the circuit is broken.

A fluid pressure of high level acts in the fluid chamber 15 at all times, and a fluid pressure controlled by the main control valve 20 acts in the fluid chamber 16. More specifically, when a fluid pressure controlled by the main control valve 20 acts in the fluid chamber 16, the piston 12 moves rightwardly to close the breaking section 2; when the fluid pressure is released from the fluid chamber 16, the piston 12 moved leftwardly to open the breaking section 2. In this type of circuit breaker, it is particularly necessary that the piston 12 move at high speed with a high degree of responsiveness and under high output power.

Figure 2:
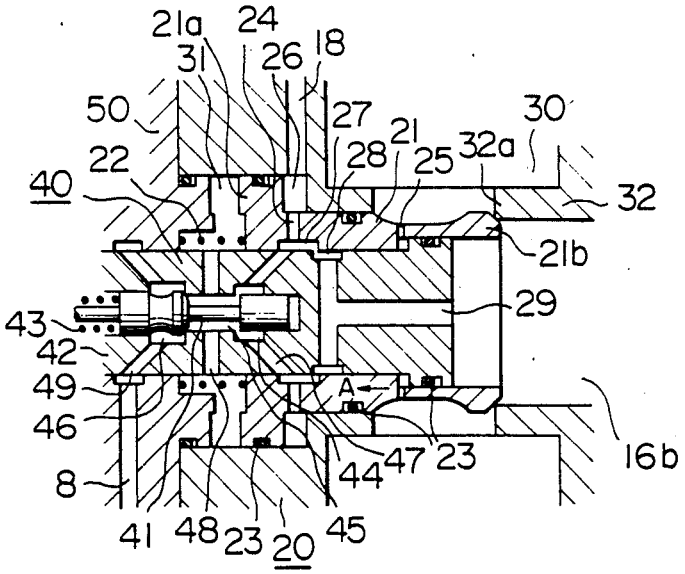
FIGS. 2 and 3 are fragmentary sectional views in explanation of the operation of the main control valve and the pilot valve of the fluid-pressure driving device shown in FIG. 1.

FIG. 2 shows in detail the construction of the main control valve 20 for controlling the fluid pressure in the fluid chamber 16 of the driving cylinder 10 which includes a valve member 21 and a valve body 32.

Figure 3:
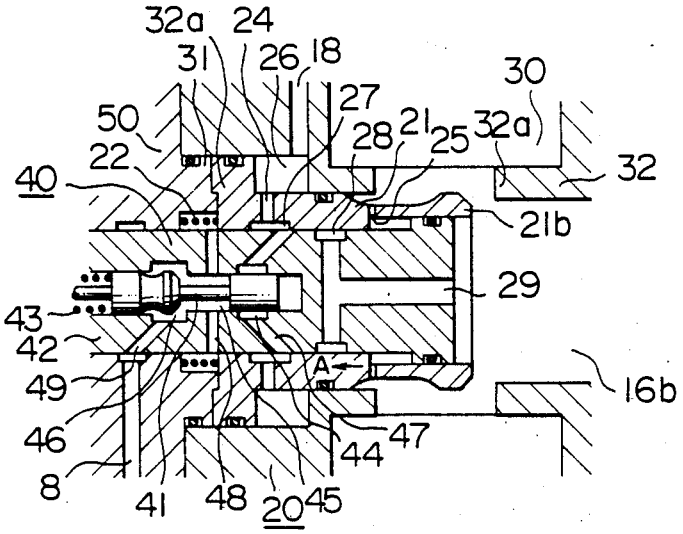

The valve member 21 which is in the form of a hollow cylinder with a flange is guided at its outer periphery by the valve body 32 and at its inner periphery by a pilot valve sleeve 42, subsequently to be described, which is secured to a valve body 50, so that the valve member 21 moves axially in sliding movement. The valve body 32 constitutes, as shown in FIG. 1, a part of the cylinder body 11 and defines therein a fluid chamber 30 communicating with the tank 5 through a channel 7. A fluid under high pressure in the fluid chamber **16*b* is filled in the fluid chamber 30 temporarily to open the breaking section 2 at high speed, and then discharged into the tank 5 through the channel 7. The flange 21*a* at one end of the valve member 21 faces fluid chambers 26 and 31, and the position of the valve member 21 may vary depending on the difference in pressure between the fluid chambers 26 and 31. The outer periphery of the valve member 21 near an opposite end is partly tapered as indicated at 21*b*, so that the flow of fluid under pressure between the fluid chamber 16*b* and a fluid chamber 30 takes place when the tapered surface 21*b* is released from contact with the valve body 32 and blocked when it is brought into contact therewith. Two fluid chambers 27 and 28 are defined between the valve member 21 and pilot valve sleeve 42 and perform the function of allowing the fluid under pressure to flow and blocking its flow when the valve member 21 moves, but their operations are reversed. That is, when one fluid chamber allows the fluid to flow, the other fluid chamber blocks its flow. The fluid chamber 27 is maintained in communication, through a plurality of ports 24 formed at the valve member 21, with the fluid chamber 26 to which the fluid under pressure is fed at all times from the fluid pressure source 4 through a channel 18, and the fluid chamber 28 is maintained in communication with the chamber 16*b* of the driving cylinder 10 through a channel 29 formed in the pilot valve sleeve 42. Thus, the main control valve acts as a three-way valve. That is, when the hollow valve body 21 is in the position shown in FIG. 2, the pressurized fluid is supplied to the chamber 16*b* through channel 18 and port 24, chambers 27, 28 and channel 29. Ath is position, the chamber 16*b* and chamber 30 are not in communication with each other. When the fluid under pressure is supplied to the fluid chamber 31 of the main control valve 20, the valve member 21 is located in the position shown in FIG. 2. When the valve member 21 is in this position, the tapered surface 21*b* of the valve member 21 is in contact with the valve body 32, so that the fluid under high pressure is supplied to the fluid chamber 16*b* of the driving cylinder 10 through the channel 18, fluid chamber 26, ports 24, fluid chambers 27 and 28 and a channel 29. As the fluid under high pressure is discharged from the fluid chamber 31 through channels 48, 49 and 8 when the pilot valve 40 subsequently to be described moves, the fluid under pressure acting in the fluid chamber 26 at all times moves the valve member 21 from its position shown in FIG. 2 to its position shown in FIG. 3. When the valve member 21 is in the position shown in FIG. 3, the fluid chambers 16*b* and 30 are maintained in communication with each other and the fluid chambers 27 and 28 are out of communication with each other. At this position, large amounts of fluid within chamber 16*b* can be discharged at high speed with a high degree or speed of response. The valve member 21 is a hollow cylinder with a ratio of the diameter of a circular portion of the valve body 32 to the weight of the valve member 21 being large. Therefore, a large amount of fluid can be discharged in a short period of time, and the driving force needed to drive the valve body 21 at high speed can be decreased. At this time, the flow of fluid under high pressure to the fluid chamber 16*b* of the driving cylinder 10 is blocked, and the fluid under pressure in the fluid chamber 16*b* is discharged to the tank 5 through the fluid chamber 30 and channel 7. Numeral 25** designates a drain port.

The pilot valve 40 comprises the pilot valve sleeve 42 and a pilot valve spool 41 driven by the force motor 60 which is located in the sleeve 42 for axial sliding movement. Fluid chambers 44, 45 and 46 are defined between the sleeve 42 and spool 41 and maintained in communication with the fluid chambers 27, 31 and tank 5 through channels 47, 48 and 49, respectively.

The pilot valve spool 41 is normally kept by the biasing force of a spring 43 in its position shown in FIG. 2 in which it brings the fluid chambers 44 and 45 into communication with each other and the fluid chambers 45 and 46 out of communication with each other. By connecting the main control valve 20 to the pilot valve 40 through the pilot valve sleeve 41 as described hereinabove, the distance between the fluid chamber 31 and pilot valve 40 is minimized and the channel connecting them together is simple in shape, so that it is possible to discharge the fluid under pressure from the fluid chamber 31 to the tank 5 at high speed and with the least resistance offered to its flow by the channel.

Referring to FIG. 1 again, the force motor 60 includes a magnet 61, a yoke 62, a pole 63, a coil 64 and a coil bobbin 65 and is operative to generate a magnetic field in a gap defined between the yoke 62 and pole 63 by the magnetomotive force of the magnet 61 to pass a current to the coil 64 inserted in the gap, to thereby produce an axial driving force which is transmitted through the coil bobbin 65 to the spool 41 of the pilot valve 40. The force motor 60 produces a high driving force even if the inductance of the coil 64 is low and the mass of its moving part is small, so that it has high responsiveness.

The driving cylinder 10, main control valve 20, pilot valve 40 and force motor 60, which are the principal components of the fluid-pressure driving device 1 according to the invention are constructed as described hereinabove. The fluid-pressure driving device 1 according to the invention operates as follows.

When the fluid-pressure driving device 1 is in the position shown in FIGS. 1 or 2, the breaking section 2 is closed or the circuit is formed. At this time, upon a command being issued by passing a current to the coil 64 of the force motor 60, the driving force of the force motor 60 causes the spool 41 of the pilot motor 40 to move in the direction of an arrow A through the coil bobbin 65. This axial movement of the spool 41 brings the fluid chambers 44 and 45 out of communication with each other and the fluid chambers 45 and 46 into communication with each other. This causes the fluid under pressure that has been supplied to the fluid chamber 31 to be discharged to the tank 5 through the fluid chambers 48, 49, 45 and 46 and channel 8. As a result, the valve member 21 of the main control valve 20 is moved by the pressure of the fluid in the direction of the arrow A to the position shown in FIG. 3. As the valve member 21 moves as described hereinabove, the fluid under pressure that has been supplied to the fluid chamber 16*b* of the driving cylinder 10 through the channel 29 is discharged at high speed to the tank 5 through the channel 7 after being temporarily led into the fluid chamber 30, so that the piston 12 is also moved at high speed in the direction of the arrow A and opens the breaking section or breaks the circuit. At this time, the distance between the fluid chambers 16*b* and 30 is minimized and the channel between them is simple in shape, to allow the fluid to flow in a large amount with the least resistance being offered by the channel. Thus, the piston 12 connected to the breaking section 2 through the rod 13 is able to operate at high speed and with a high degree of responsiveness to provide a high output power. By forming the fluid chamber 30 as a cavity, its performance can be improved to a degree such that the resistance offered to the flow of fluid can be neglected. Moreover, the force motor 60 and pilot valve spool 41 have high responsiveness, and the discharge of fluid from the fluid chamber 31 takes place at high speed with a high degree of responsiveness and meets with minimized resistance offered by the channel, thereby enabling the valve member 21 of the main control valve 20 to respond quickly to the discharge of fluid from the fluid chamber 31.

When it is desired to close the breaking section 2 or form a circuit, a current is passed to the coil 64 of the force motor 60 to give a command to move the spool 41 of the pilot valve 40 to move in a direction opposite the direction of the arrow A. The driving force of the force motor 60 moves the spool 41 through the coil bobbin 65 in the direction opposite the direction of the arrow A. This axial movement of the spool 41 brings the fluid chambers 45 and 46 out of communication with each other and the fluid chambers 44 and 45 into communication with each other. This causes the fluid under pressure that has been supplied to the fluid chamber 26 to be supplied to the fluid chamber 31 through the ports 24, fluid chambers 27, 44 and 45 and channel 48. This causes the valve member 21 to move in the direction opposite the direction of the arrow A until the tapered surface 21*b* thereof is brought into contact with the valve body 32 and stops (as shown in FIG. 2). When the valve member 21 is in this position, the fluid under pressure that has been supplied to the fluid chamber 26 through the channel 8 is supplied to the fluid chamber 16*a* of the driving cylinder 10 through the ports 24, fluid chambers 27 and 28, channel 29 and fluid chamber 16. This causes the piston 12 to move in the direction opposite the direction of the arrow A and closes the breaking section 2 through the rod 13. The cushion protrusions 14*a* and 14*b* on the left and right sides of the piston 12 differ from each other in the area of a surface to which pressure is applied, so that the piston 12 is of a differential offset rod type. The flange 21*a* of the valve member 21 has surfaces on left and right sides for receiving pressure which differ from each other in area.

From the foregoing description, it will be appreciated that, in the fluid-pressure driving device according to the invention, the valve member of the main control valve close to the driving cylinder is in the form of a hollow cylinder and interposed between the valve body of the main control valve, which constitutes a part of the cylinder body of the driving cylinder, and the pilot valve sleeve. By this arrangement, the channels connecting the driving cylinder to the main control valve and the main control valve to the pilot valve can have their lengths minimized and their shape simplified. This is conductive to a reduction in the time required for transmitting a driving force and a minimization of the resistance offered by the channels to the flow of fluid. Thus, the fluid-force driving device according to the invention is capable of providing a high speed operation with a high degree of responsiveness.

What is claimed is:

1. A fluid-pressure driving device comprising:

a driving cylinder including a cylinder body and a differential piston arranged within said cylinder body so as to define a first fluid chamber at one side of said piston and a second fluid chamber at the other side of said piston, first fluid passage means for supplying pressurized fluid to said first fluid chamber from a source of pressurized fluid, second fluid passage means for supplying pressurized fluid to said second fluid chamber from said source of pressurized fluid and third fluid passage means for discharging pressurized fluid from said second fluid chamber to a tank;

main control valve means for selectively controlling the direction of movement of the piston of said driving cylinder within said cylinder body, said main control valve means including a valve body which constitutes a part of said cylinder body of said driving cylinder and a valve member which is a hollow cylinder slidably arranged in said valve body for movement between a first position wherein said second fluid passage means is open for supplying pressurized fluid from said source to said second fluid chamber and said third fluid passage means is closed, and a second position wherein said second fluid passage means is closed and said third fluid passage means is open for discharging pressurized fluid from the second fluid chamber to said tank, said main control valve means further including a third fluid chamber adjacent a first surface of said valve member for pressurized fluid from said source to bias said valve member in a direction of one of said first and second positions; and a fourth fluid chamber adjacent a second surface of said valve member for pressurized fluid from said source for biasing said valve member in a direction of the other position of said first and second positions, and pilot valve means for controlling the flow of pressurized fluid to and from at least one of said third and fourth chambers for controlling the movement of the valve member of said main control valve means, said pilot valve means including a pilot valve sleeve and a pilot valve spool slidably mounted within said pilot valve sleeve, said valve member of said main control valve means being arranged between the valve body and said pilot valve sleeve.

2. A fluid-pressure driving device as claimed in claim 1, wherein pressurized fluid is supplied to said second fluid chamber by said second fluid passage means so as to flow along an inner periphery surface of the valve member of the main control valve means and pressurized fluid is discharged from said second fluid chamber by said third fluid passage means so as to flow along an outer periphery surface of said valve member.

3. A fluid-pressure driving device as claimed in claim 1, wherein said second fluid chamber is formed in said driving cylinder in cooperation with the main control valve means.

4. A fluid-pressure driving device as claimed in claim 1, wherein said valve body of said main control valve is formed with a hollow space as part of said third fluid passage means, said hollow space being located to temporarily admit thereto a fluid discharged from the second fluid chamber of the driving cylinder before the fluid is discharged to a tank.

5. A fluid-pressure driving device as claimed in claim 1, further comprising a force motor operatively associated with said pilot valve spool for driving said pilot valve spool.

* * * * *